US007036404B2

(12) United States Patent
Liou

(10) Patent No.: US 7,036,404 B2
(45) Date of Patent: May 2, 2006

(54) TOOL INCLUDING BIT AND HANDLE

(76) Inventor: Mou-Tang Liou, No. 57, Kung Yeh North Road., Nan Kang Industrial Park, Nantou City, Nantou Hsien (TW)

( * ) Notice: Subject to any disclaimer, the term of this patent is extended or adjusted under 35 U.S.C. 154(b) by 0 days.

(21) Appl. No.: 10/805,959

(22) Filed: Mar. 22, 2004

(65) Prior Publication Data

US 2004/0173061 A1 Sep. 9, 2004

Related U.S. Application Data

(63) Continuation-in-part of application No. 10/271,274, filed on Oct. 16, 2002, now Pat. No. 6,725,749.

(51) Int. Cl.
*B25B 23/00* (2006.01)

(52) U.S. Cl. ..... 81/438; 81/443

(58) Field of Classification Search ..... 81/438, 81/439, 443, 455, 446, 177.85, 177.2
See application file for complete search history.

(56) References Cited

U.S. PATENT DOCUMENTS 2,592,978 A * 4/1952 Trimboli ..... 81/177.1
2,963,930 A * 12/1960 Clothier et al. ..... 81/177.2
4,367,663 A * 1/1983 Merics ..... 81/177.2
4,586,406 A * 5/1986 Howard ..... 81/177.2
4,692,073 A * 9/1987 Martindell ..... 408/239 A
5,013,194 A * 5/1991 Wienhold ..... 408/240
5,309,798 A * 5/1994 Markwart et al. ..... 81/438
5,481,949 A * 1/1996 Yen ..... 81/438
5,533,429 A * 7/1996 Kozak ..... 81/439
5,685,208 A * 11/1997 Tidwell ..... 81/177.85
5,934,384 A * 8/1999 Wang ..... 173/132
6,089,133 A * 7/2000 Liao ..... 81/438
6,199,872 B1 * 3/2001 Hasan ..... 279/30
6,325,393 B1 * 12/2001 Chen et al. ..... 279/22
6,363,819 B1 * 4/2002 Li ..... 81/438
6,408,721 B1 * 6/2002 Lee ..... 81/60
6,637,755 B1 * 10/2003 Chen et al. ..... 279/22
6,643,877 B1 * 11/2003 Amtenbrink et al. ..... 7/125
6,722,667 B1 * 4/2004 Cantlon ..... 279/22
6,874,791 B1 * 4/2005 Chen et al. ..... 279/75

* cited by examiner

*Primary Examiner*—David B. Thomas
(74) *Attorney, Agent, or Firm*—Charles E. Baxley

(57) ABSTRACT

A handle is provided for use with a bit or extensive rod. The handle includes a socket. The socket includes a thin section, a thick section, an annular face between the thin and thick sections, an axial cavity and a radial aperture communicated with the axial cavity in the thin section. A detent is put in the radial aperture. A chuck is put on the socket for control over the detent.

15 Claims, 10 Drawing Sheets

TOOL INCLUDING BIT AND HANDLE

CROSS-REFERENCE

The present application is a continuation-in-part application of U.S. patent application Ser. No. 10/271,274 filed on Oct. 16, 2002 now U.S. Pat. No. 6,725,749.

FIELD OF INVENTION

The present invention relates to a tool including a bit and a handle for releasable engagement with the bit.

BACKGROUND OF INVENTION

In U.S. Pat. No. 5,934,384, a shaft 1, a stop 2, a C-clip 3, a spring 4, a ring 5, a chuck 6, a magnet 7 and a bit 8 are disclosed (FIG. 2). The shaft 1 includes a polygonal hole 10 in an end, an annular grove 11 in the periphery, an aperture 110 communicating the polygonal hole 10 with the annular groove 11, an annular groove 12 in the periphery and a polygonal rod 13 at an opposite end. The stop 2 includes a rod 20 extending from a central portion. The stop 2 is put in the annular groove 11 so that the rod 20 can be inserted into the polygonal hole 10 through the aperture 110. The C-clip 3 is put in the annular groove 12. The magnet 7 is fit in the polygonal hole 10. The chuck 6 includes a tapered orifice 61. The chuck 6 is put around the shaft 1. The spring 4 is put around the shaft 1 and in the chuck 6. The ring 5 is put around the shaft 1 and fit in the chuck 6. Thus, the chuck 6 is kept around the shaft 1. Due to the spring 4 compressed between the C-clip 3 and the ring 5, the chuck 6 is biased in a direction so that the tapered orifice 61 pushes the stop 2 so as to insert the rod 20 into the polygonal hole 10 (FIG. 4). The bit 8 includes a polygonal shank 80 that includes several corners 81 each defining a cut 82. The chuck 6 can be moved in an opposite direction so that the tapered orifice 61 releases the stop 2 so as to allow the rod 20 to leave the polygonal hole 10 (FIG. 6). Thus, the bit 8 can be inserted in the polygonal hole 10. The chuck 6 can be released so that the rod 20 is inserted into one of the cuts 82. Thus, the bit 8 is kept on the shaft 1. The rod 20 is however inadequate to keep the bit 8 on the shaft 1. When this happens during operation, the bit 8 might cause human casualty.

There have been devised various hand tools that each include a bit engaged with a handle in a releasable manner. Generally, such a bit includes an insert, and such a handle includes a socket for receiving the insert. A locking device is used to lock the insert in the socket.

SUMMARY OF INVENTION

It is an objective of the present invention to provide a tool including a bit and a handle engaged with the bit in a releasable manner.

According to the present invention, a handle is provided for use with a bit or extensive rod. The handle includes a socket. The socket includes a thin section, a thick section, an annular face between the thin and thick sections, an axial cavity and a radial aperture communicated with the axial cavity in the thin section. A detent is put in the radial aperture. A chuck is put on the socket for control over the detent.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the drawings.

DETAILED DESCRIPTION OF EMBODIMENTS

Figure 1:
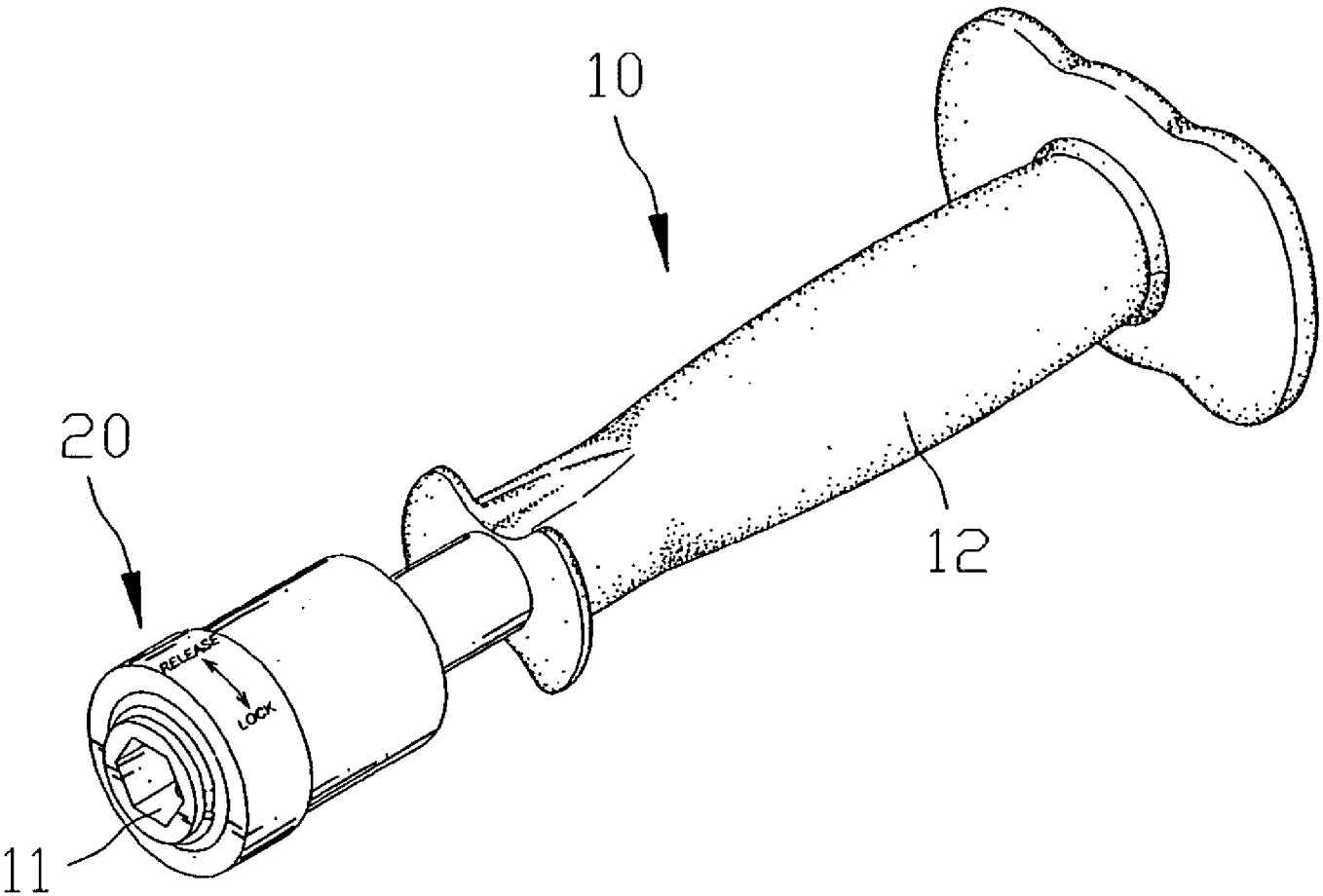
FIG. 1 is a perspective view of a handle for releasable engagement with a bit according to a first embodiment of the present invention.

FIG. 1 shows a handle 10 according to a first embodiment of the present invention. The handle 10 can be engaged with a bit 30 (FIG. 4) in a releasable manner to be described.

Figure 2:
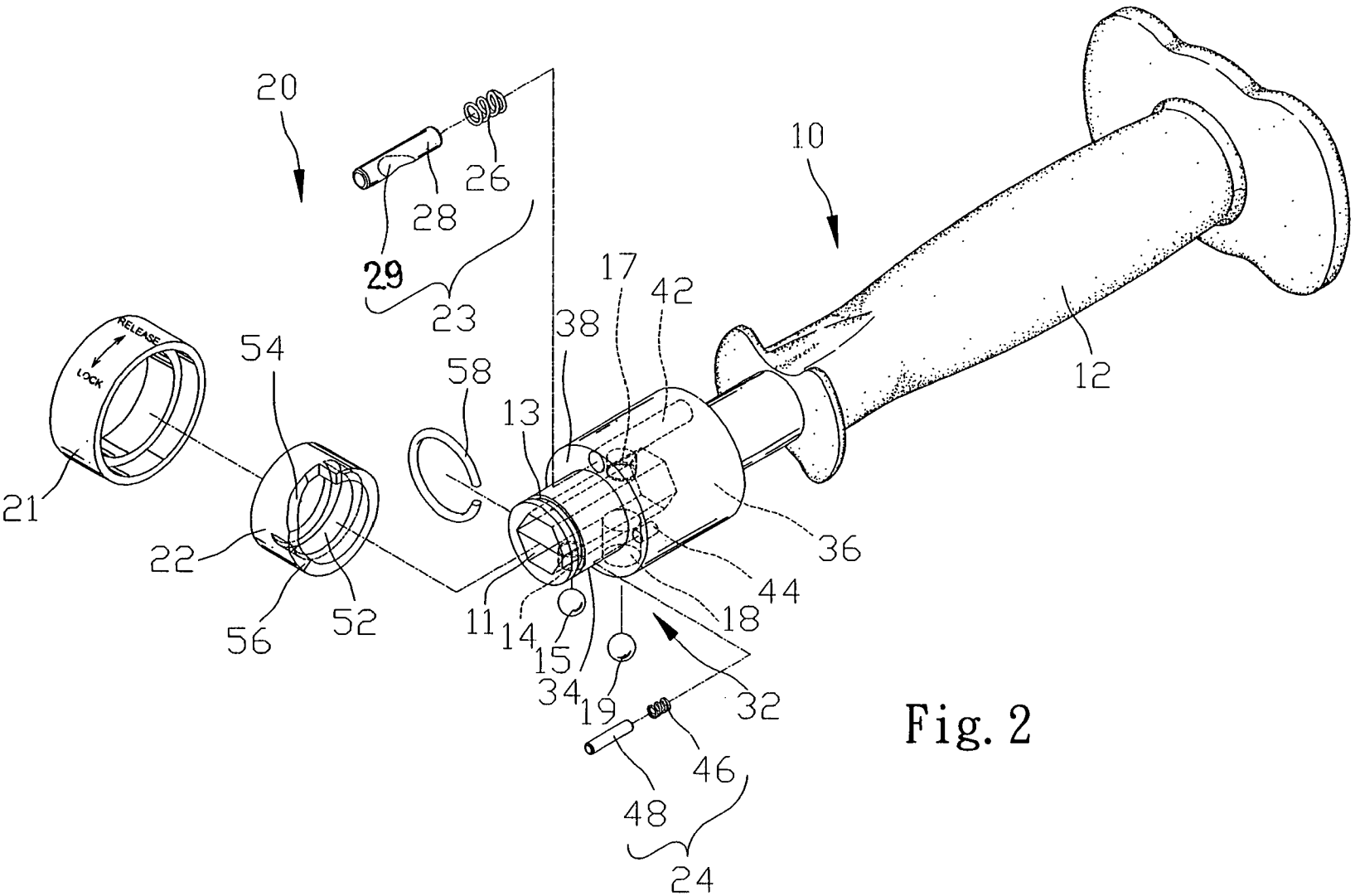
FIG. 2 is an exploded view of the handle shown in FIG. 1.

Referring to FIG. 2, the handle 10 includes a socket 32, a grip 12 extending from the socket 32 and a chuck 20 put around the socket 32.

The periphery of the socket 32 includes a thin section 34 and a thick section 36 so as to form an annular face 38 between the thin section 34 and the thick section 36. The socket 32 includes an annular groove 13 defined in the thin portion 34, an axial cavity 11 defined therein an end, a radial aperture 14 communicated with the axial cavity 11 in the thin section 34, a radial cavity 17 communicated with the axial cavity 11 in the thick section 36, a radial aperture 18 communicated with the axial cavity 11 opposite to the radial cavity 17, a longitudinal cavity 42 defined in the annular face 38 and communicated with the radial cavity 17 and a longitudinal cavity 44 defined in the annular face 38.

A detent 15, in the form of a ball, is put in the radial aperture 14. A detent 19, in the form of a ball, is put in the radial cavity 17 through the radial aperture 18.

The chuck 20 includes a check device 24, a control device 23, an operative ring 22 and an instructive ring 21.

The check device 24 includes a spring 46 and a detent 48 in the form of a pin. The spring 46 and the detent 48 are both put in the longitudinal cavity 44.

The control device 23 includes a spring 26 and a rod 28 both put in the longitudinal cavity 42 for control over the detent 19. Biased via the spring 26, the rod 28 is movable in the longitudinal cavity 42. The rod 28 defines a recess 29 for receiving the detent 19.

To lock and release the bit 30, the operative ring 22 is used to control the detent 15 directly and the detent 19 through the control device 23. The operative ring 22 includes a groove 52 defined in an internal face in order to receive a portion of the detent 15. The groove 52 gets deeper from a first end to a second end. The operative ring 22 includes a recess 54 defined in an edge or end in order to receive an end of the rod 28. The recess 54 gets shallower from a first end to a second end. The operative ring 22 includes a recess 56 defined in the edge or end in order to receive an end of the detent 48.

On the instructive ring 21 is provided an instruction regarding directions in which the chuck 20 should rotated in order to lock and release the bit 30. The instructive ring 21 is put around the operative ring 22. The operative ring 22 is put around the thin section 38 of the socket 32 in a rotational manner. The groove 52 receives a portion of the detent 15. The recess 54 receives a portion of the detent 19. A C-clip 58 is fit in the annular groove 13 in order to keep the chuck 20 on the socket 32.

Figure 3:
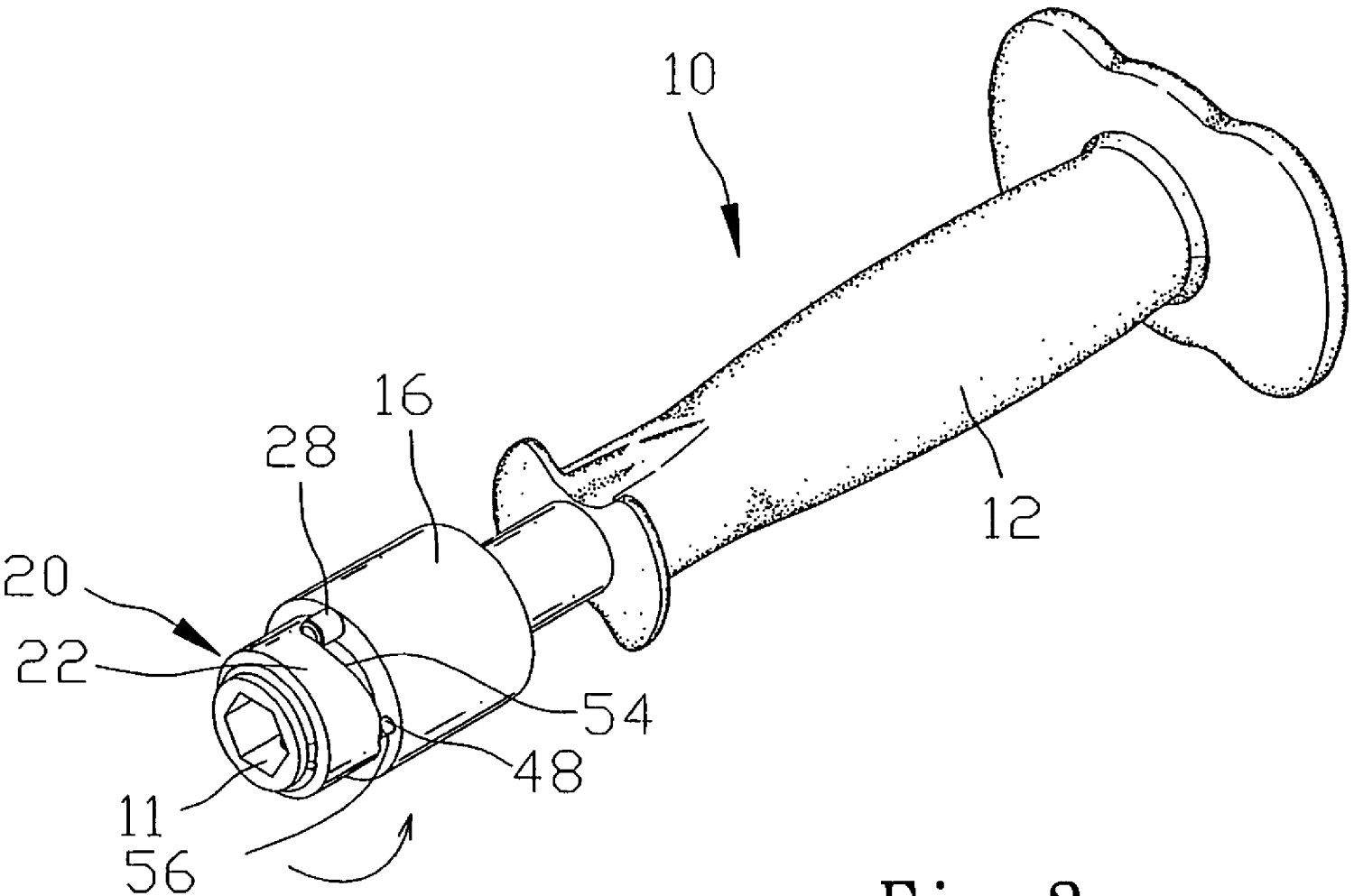
FIG. 3 is a perspective partial view of the handle shown in FIG. 2.
Figure 4:
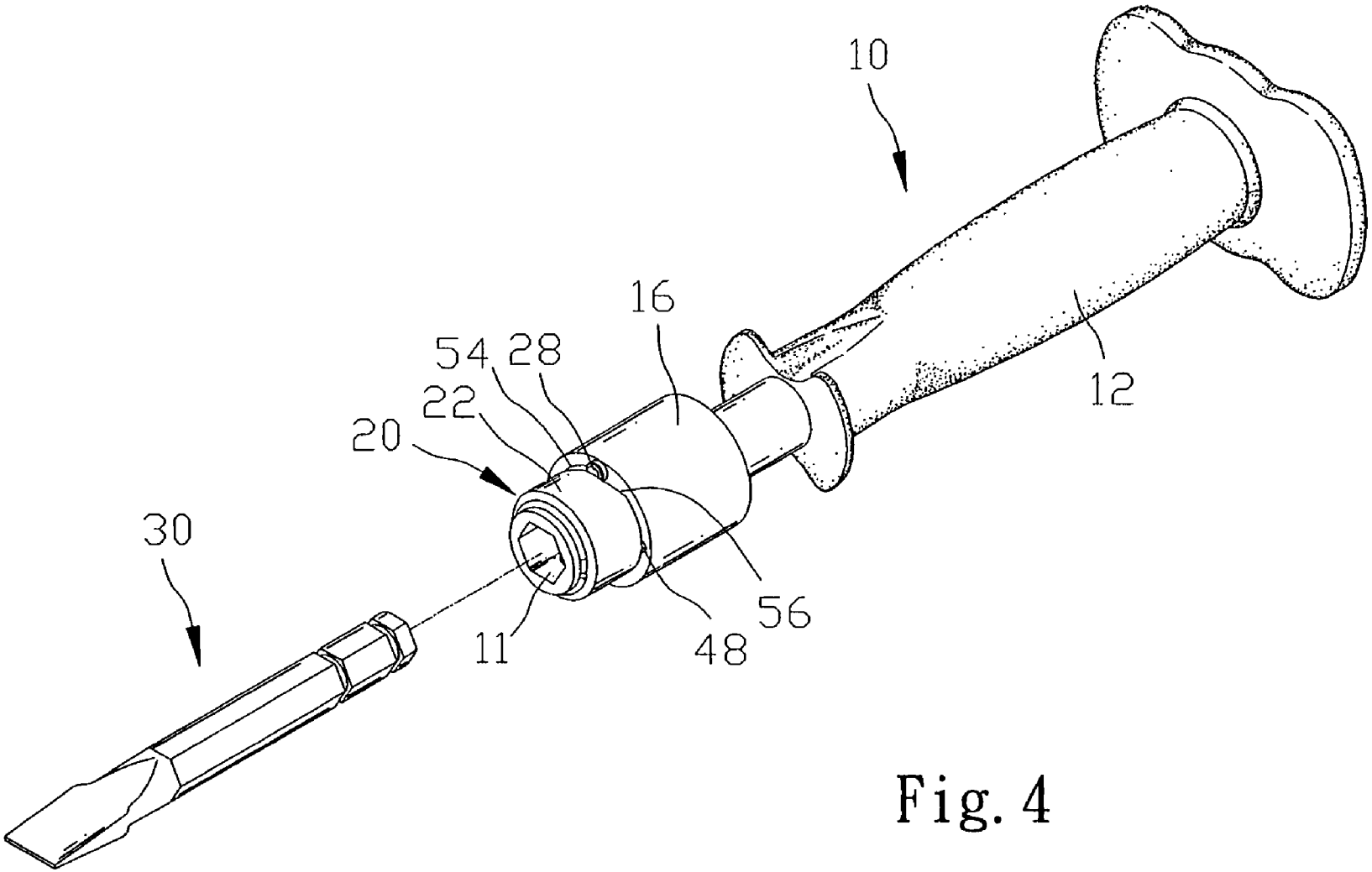
FIG. 4 is a perspective view of a bit to be engaged with the handle shown in FIG. 3.

The operative ring 22 can be rotated between a locking position shown in FIG. 3 and a releasing position shown in FIG. 4.

Figure 5:
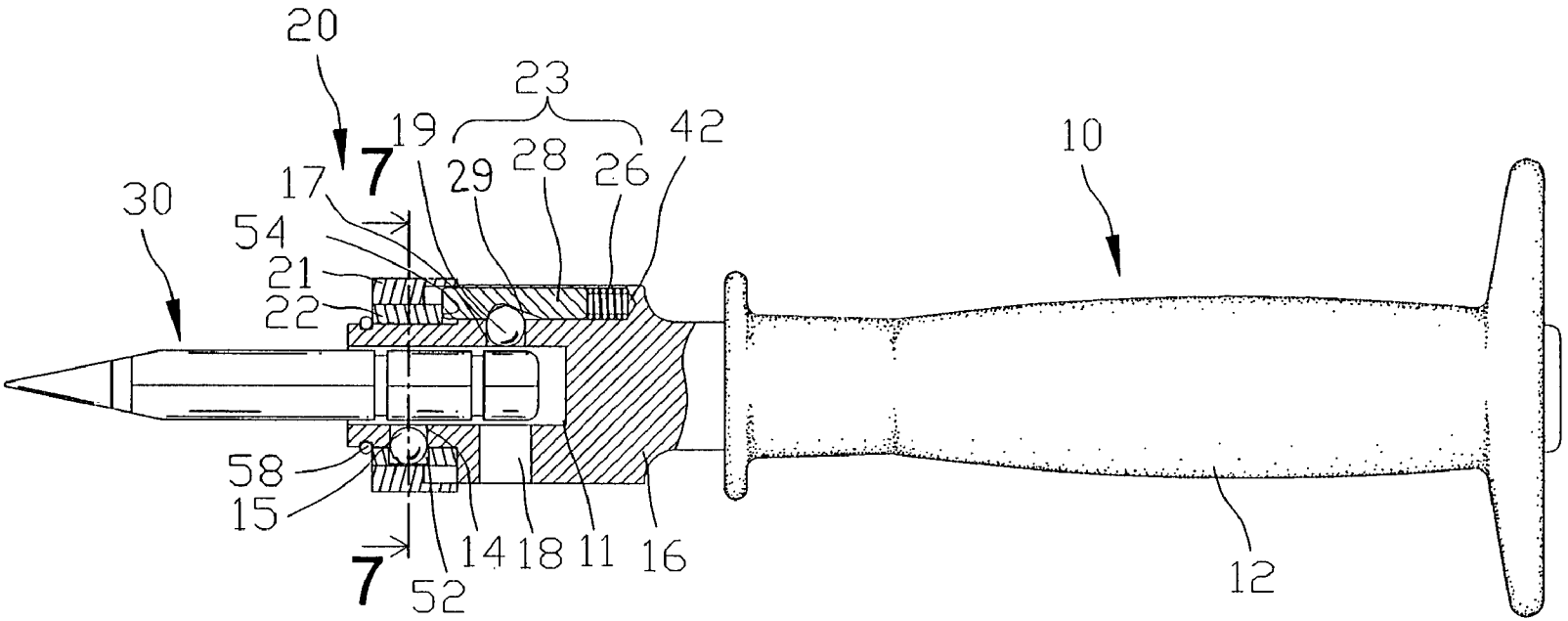
FIG. 5 is a cutaway view of the bit shown in FIG. 4 engaged with the handle shown in FIG. 2.
Figure 7:
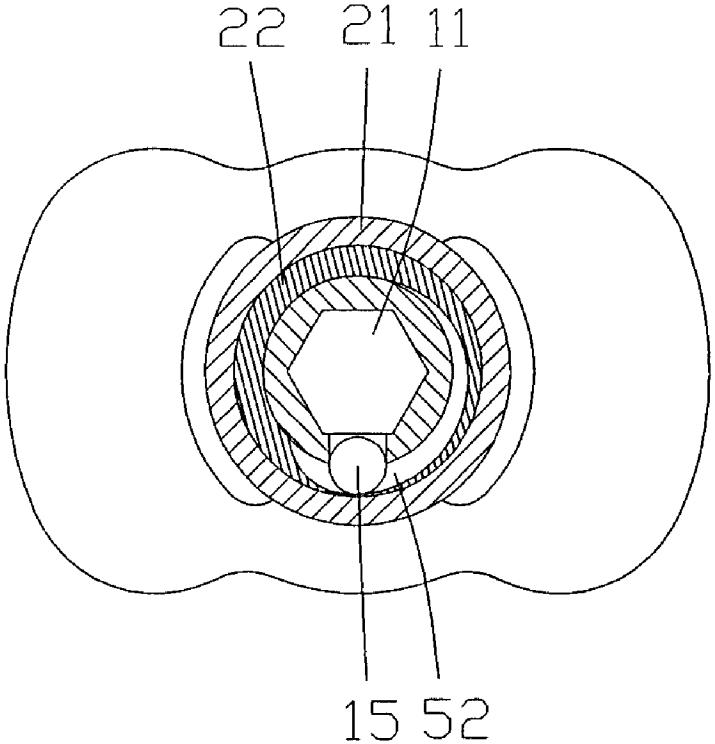
FIG. 7 is a cross-sectional view taken along a line 7—7 in FIG. 5.

Referring to FIGS. 4, 5 and 7, in the releasing position, the detent 15 is put at the second end of the groove 52 so that it stays completely off the axial cavity 11. The rod 23 is put at the second end of the recess 54. Hence, the detent 19 is located at the deepest portion of the recess 29 so that it stays completely off the axial cavity 11. Therefore, the bit 30 can be inserted into the axial cavity 11.

Figure 6:
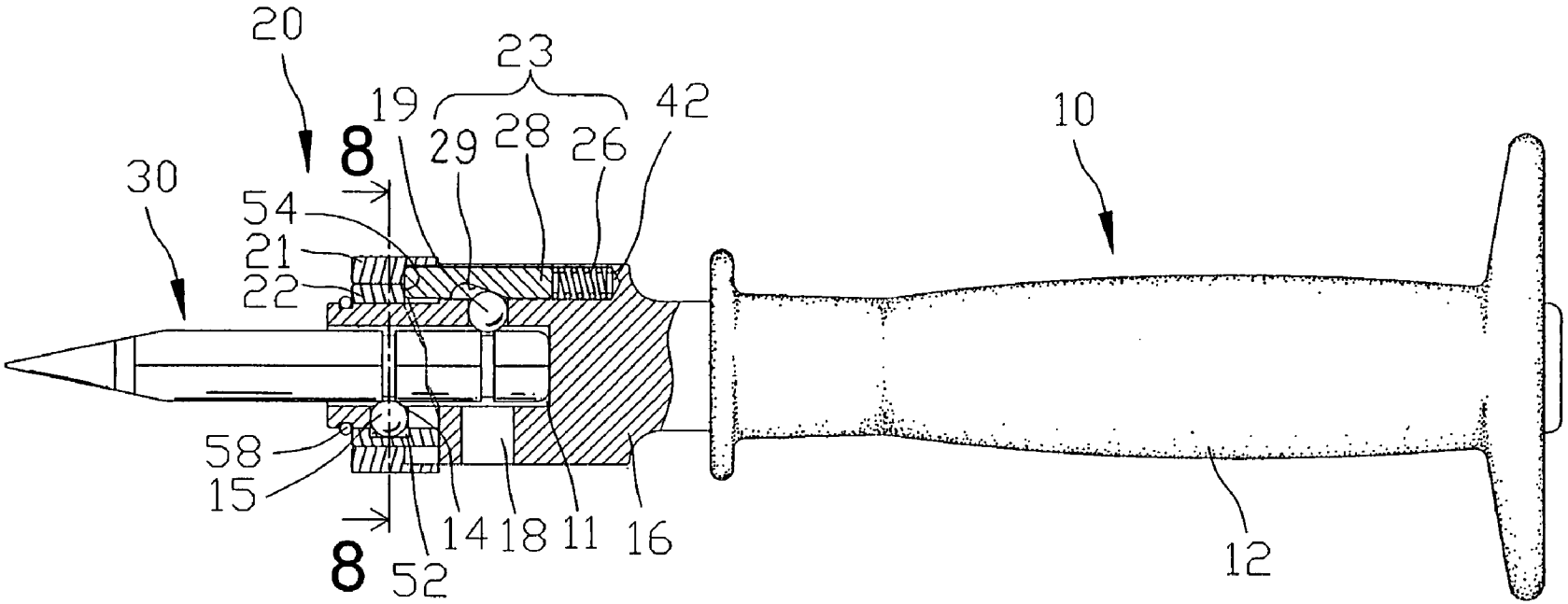
FIG. 6 is similar to FIG. 5 but shows the bit in a different position with respect to the handle.
Figure 8:
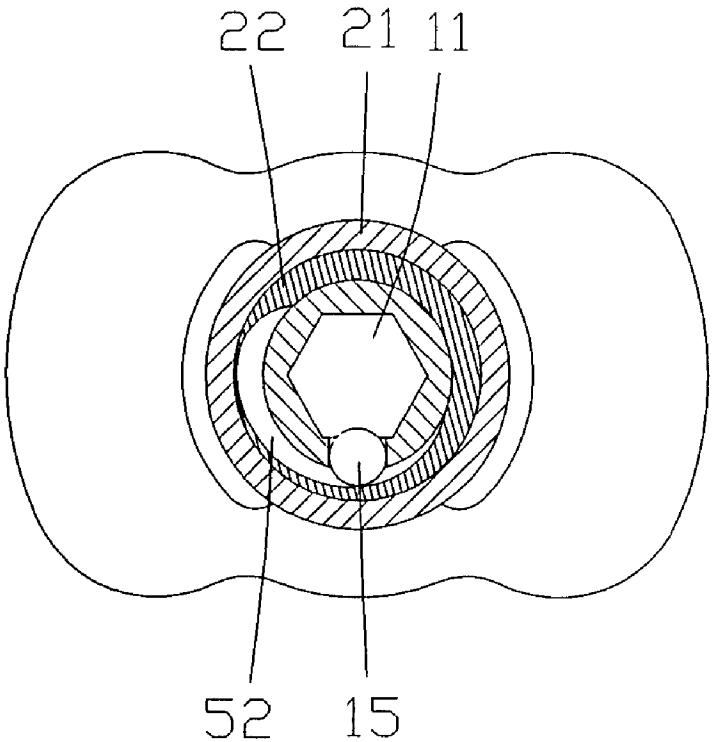
FIG. 8 is a cross-sectional view taken along a line 8—8 in FIG. 5.

Referring to FIGS. 3, 6 and 8, in the locking position, the detent 15 is put at the first end of the groove 52 so that it enters partially in an annular groove defined in the bit 30 in the axial cavity 11. The rod 23 is put at the second end of the recess 54. Hence, the detent 19 is located at a shallow portion of the recess 29 so that it enters partially in another annular groove defined in the bit 30 in the axial cavity 11. Therefore, a portion of the bit 30 is locked in the axial cavity 11.

Figure 9:
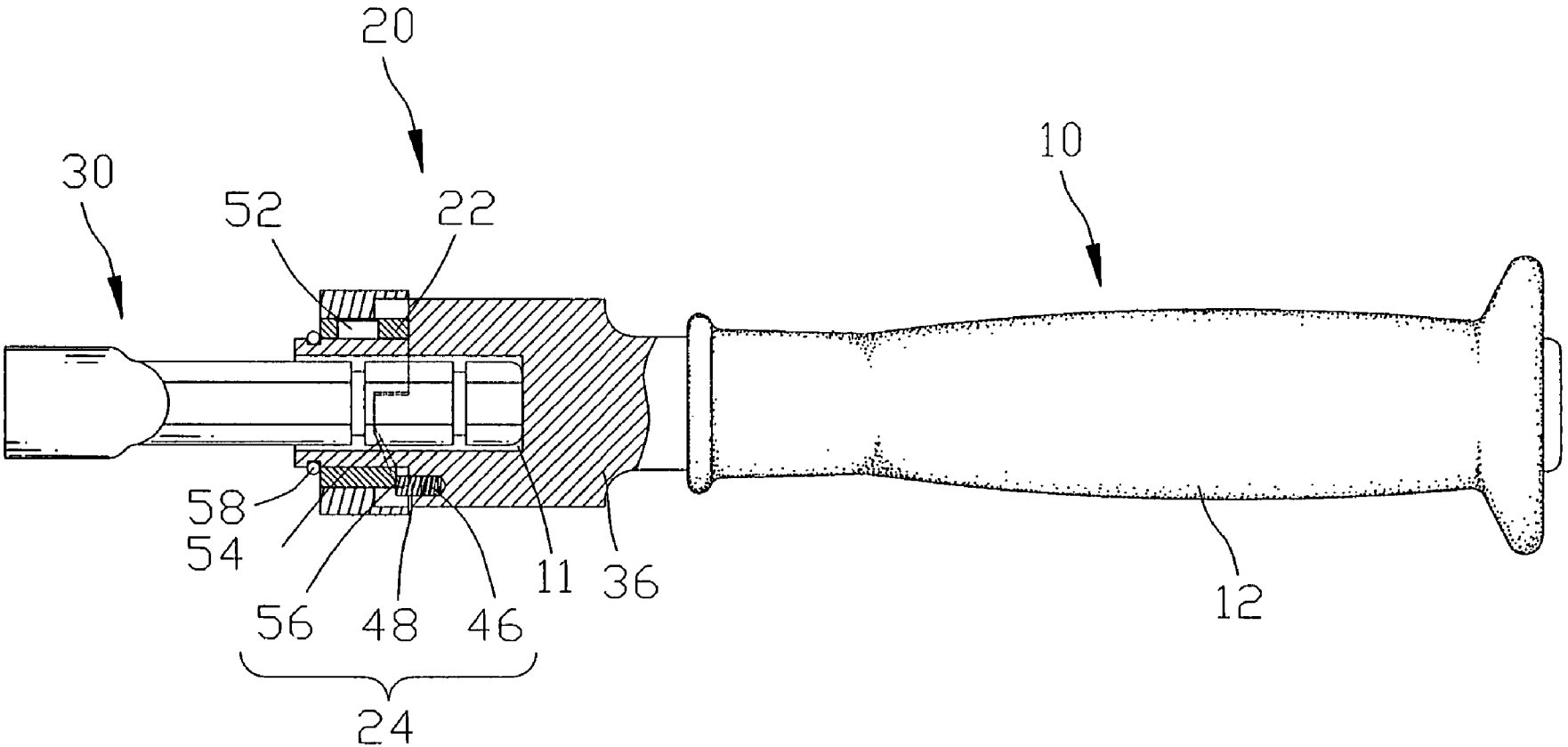
FIG. 9 is another cutaway view of the bit and the handle in FIG. 6.

Referring to FIG. 9, in the locking position, the detent 48 is put in the recess 56 so as to keep the chuck 20 in the locking position. With the insertion of the detent 48 in the recess 56, it is ensured that the chuck 20 stays in the locking position in operation of the handle 10 and the bit 30.

Figure 10:
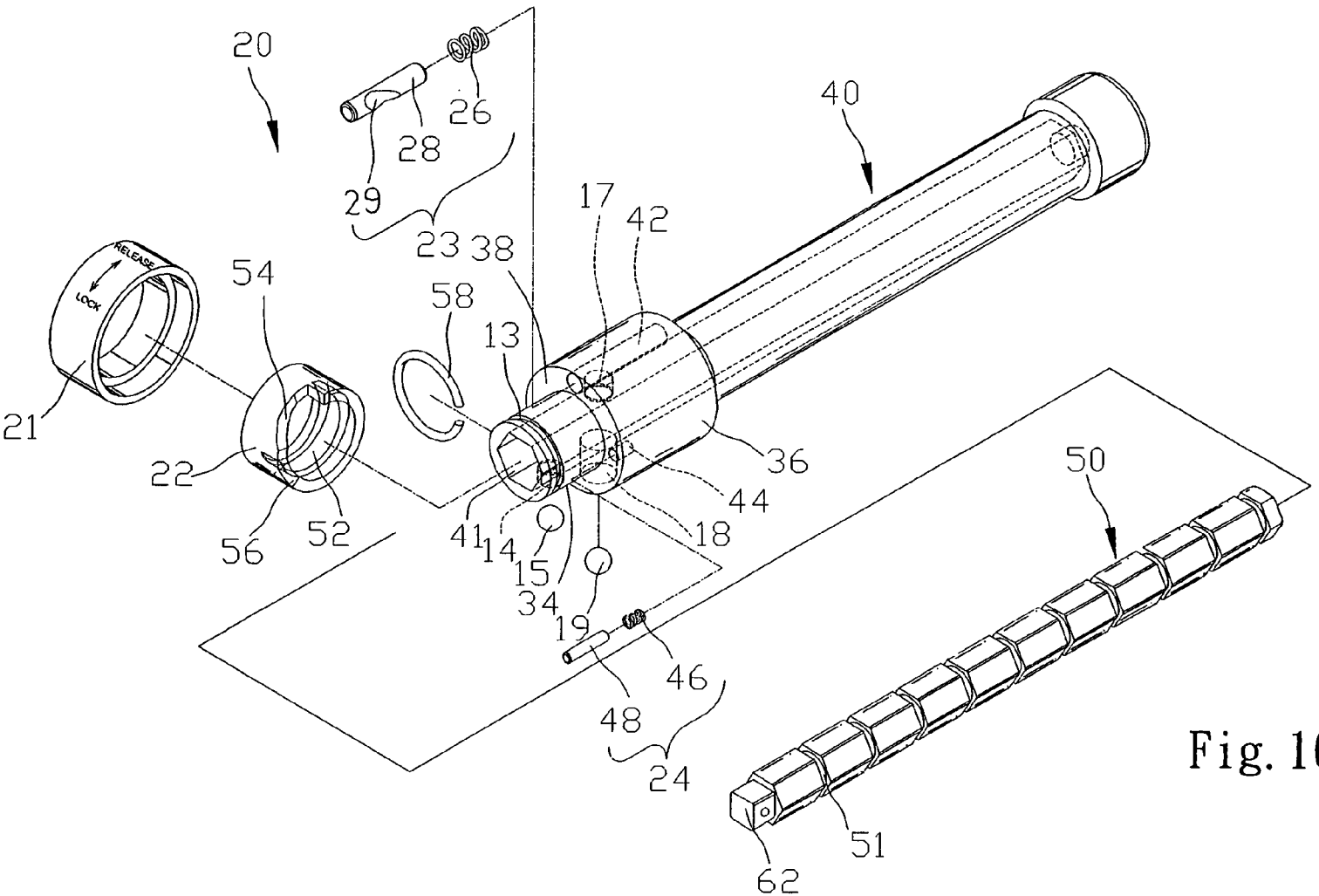
FIG. 10 is an exploded view of a handle according to a second embodiment of the present invention.
Figure 11:
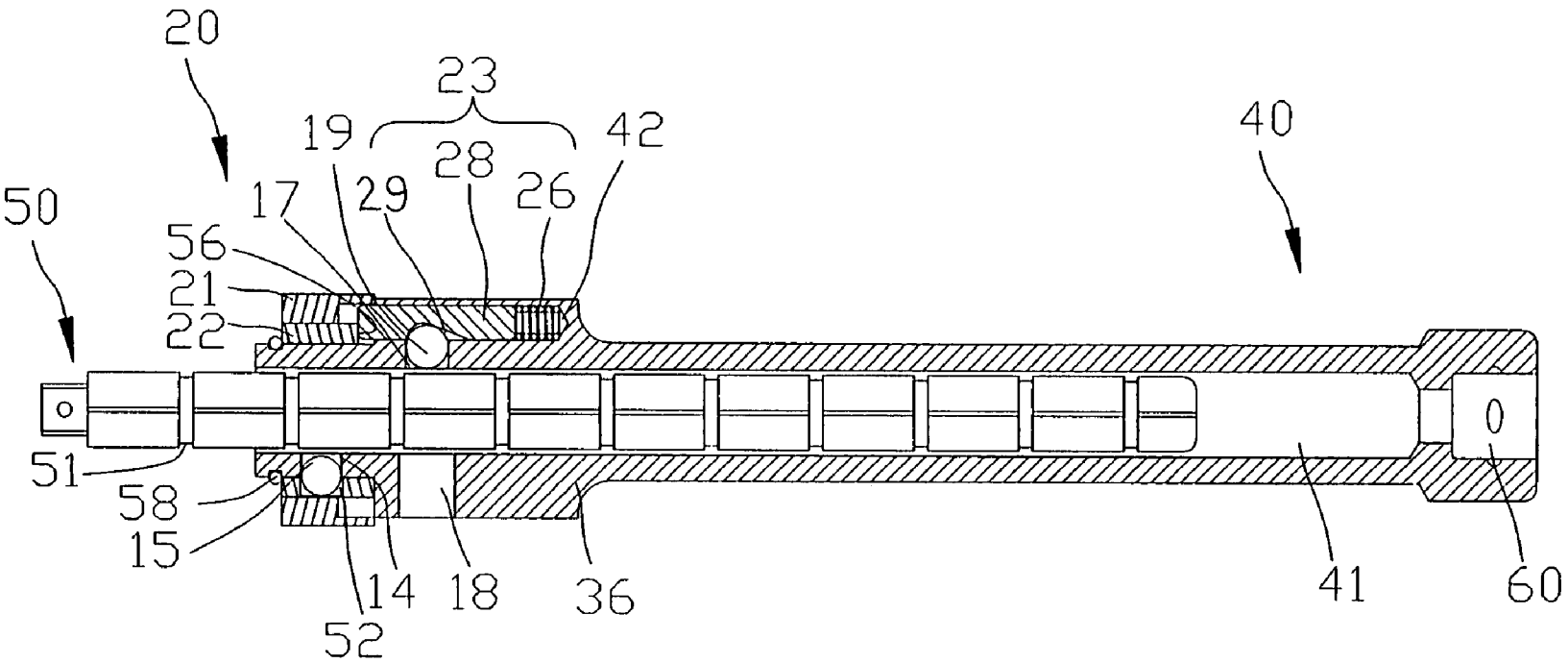
FIG. 11 is a cross-sectional view of the handle shown in FIG. 10.

FIGS. 10 and 11 show a handle 40 according to a second embodiment of the present invention. The handle 40 is identical to the handle 10 except for three things. Firstly, the handle 40 excludes the grip 12. Secondly, the handle 40 includes an axial cavity 41 longer than the axial cavity 11. Thus, the handle 40 can receive a long extensive shaft 50 instead of the bit 30. Finally, the handle 40 includes another axial cavity 60 opposite to the axial cavity 41. The axial cavity 60 enables the handle 40 to engage with a driving device (not shown).

The present invention has been described via detailed illustration of two embodiments. Those skilled in the art can derive variations from these embodiments without departing from the scope of the present invention. Therefore, these embodiments shall not limit the scope of the present invention defined in the claims.

The invention claimed is:

1. A handle for use with a bit, the handle including:

a socket including a thin section, a thick section, an annular face between the thin and thick sections, an axial cavity and a radial aperture communicated with the axial cavity in the thin section;

a first detent put in the radial aperture; and a chuck installed on the socket for control over the first detent further including a second detent, wherein the socket includes a radial cavity communicated with the axial cavity in the thick section in order to receive the second detent.

2. The handle according to claim 1 wherein the chuck is for control over the first and second detents.

3. The handle according to claim 1 wherein the second detent is in the form of a ball.

4. The handle according to claim 1 wherein the chuck includes a control device installed on the socket for control over the second detent.

5. The handle according to claim 4 wherein the socket includes a longitudinal cavity defined in the annular face and communicated with the radial cavity in order to receive the control device.

6. The handle according to claim 5 wherein the control device includes a spring and a rod biased by means of the spring, and the rod includes a recess in order to receive the second detent.

7. The handle according to claim 6 wherein the chuck includes an operative ring put rotationally on the thin section of the socket for direct control over the first detent and for control over the second detent via the control device.

8. The handle according to claim 7 wherein the operative ring includes a recess in an edge in order to receive the rod, and the recess gets shallower from an end to an opposite end.

9. The handle according to claim 7 wherein the operative ring includes a groove in an internal face in order to receive the first detent, and the groove gets deeper from an end to an opposite end.

10. A handle for use with a bit, the handle including:

a socket including a thin section, a thick section, an annular face between the thin and thick sections, an axial cavity and a radial aperture communicated with the axial cavity in the this section;

a first detent put in the radial aperture; and a chuck installed on the socket for control over the first detent, further including a second detent, wherein the socket includes a radial cavity communicated with the axial cavity in the thick section in order to receive the second detent.

11. The handle according to claim 10 wherein the socket includes a longitudinal socket in the annular face in order to receive the check device.

12. The handle according to claim 11 wherein check device includes a spring and a detent biased by means of the spring, and the operative ring includes a recess in an edge in order to receive the detent of the check device.

13. The handle according to claim 12 wherein the detent of the check device is in the form of a pin.

14. The handle according to claim 10 wherein the socket includes a radial aperture through which the second detent is put into the axial cavity.

15. A handle for use with a bit, the handle including:

a socket including a thin section, a thick section, an annular face between the thin and thick sections, an axial cavity and a radial aperture communicated with the axial cavity in the this section;

a first detent put in the radial aperture; and a chuck installed on the socket for control over the first detent further including a check device installed on the socket in order to retain the chuck.

* * * * *